US011802532B2

(12) United States Patent
Björkman et al.

(10) Patent No.: US 11,802,532 B2
(45) Date of Patent: Oct. 31, 2023

(54) STARTER PULLEY ARRANGEMENT

(71) Applicant: HUSQVARNA AB, Huskvarna (SE)

(72) Inventors: Peter Björkman, Gränna (SE); Alex Rasooli, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 17/965,398

(22) Filed: Oct. 13, 2022

(65) Prior Publication Data

US 2023/0123394 A1 Apr. 20, 2023

(30) Foreign Application Priority Data

Oct. 14, 2021 (SE) ..... 2151263-7

(51) Int. Cl.
*F02N 3/02* (2006.01)

(52) U.S. Cl.
CPC ..... *F02N 3/02* (2013.01)

(58) Field of Classification Search
CPC ..... F02N 3/02; F02N 5/02
See application file for complete search history.

(56) References Cited

U.S. PATENT DOCUMENTS

| | | | | |
|---|---|---|---|---|
| 3,782,355 | A | 1/1974 | Hamman | |
| 3,871,350 | A | 3/1975 | Hamman | |
| 5,163,393 | A | 11/1992 | Naeslund | |
| 5,287,832 | A | 2/1994 | Uhl | |
| 7,028,658 | B2 | 4/2006 | Kruse et al. | |
| 7,287,505 | B2 | 10/2007 | Kruse et al. | |
| 10,954,910 | B2 | 3/2021 | Densborn et al. | |
| 2002/0185352 | A1* | 12/2002 | Husges | F02N 3/02 74/6 |
| 2004/0149249 | A1* | 8/2004 | Kruse | F02N 3/02 123/185.3 |
| 2004/0250786 | A1* | 12/2004 | Kruse | F02N 3/02 123/185.3 |
| 2006/0288970 | A1* | 12/2006 | Miyake | F01P 5/06 123/185.3 |
| 2007/0295298 | A1 | 12/2007 | Mark | |

(Continued)

FOREIGN PATENT DOCUMENTS

| | | | |
|---|---|---|---|
| EP | 0102954 | B1 | 5/1986 |
| WO | 2013137783 | A1 | 9/2013 |

(Continued)

OTHER PUBLICATIONS

Office Action and Search Report for Swedish Application No. 2151263-7 dated May 30, 2020.

*Primary Examiner* — Logan M Kraft
*Assistant Examiner* — Anthony L Bacon
(74) *Attorney, Agent, or Firm* — Burr & Forman LLP

(57) ABSTRACT

The present disclosure relates to a starter pulley arrangement for an internal combustion engine. The arrangement comprises a cord drum (1) configured to house a starting rope wound thereon, a driver (3) configured to interact with a flywheel (5) or other part connected to an engine crankshaft, and a torsion spring (7) connecting the cord drum (1) to the driver (3), such that the cord drum can resiliently urge the engine crankshaft via the driver. The torsion spring (7) is tensioned in a resting position where the driver does not influence the crankshaft. This provides an improved resistance against wear on the parts of the starter pulley arrangement.

9 Claims, 2 Drawing Sheets

(56) References Cited

U.S. PATENT DOCUMENTS

| | | | | |
|---|---|---|---|---|
| 2010/0170465 | A1* | 7/2010 | Eakins, Jr. | F02N 3/02<br>123/185.3 |
| 2016/0290303 | A1* | 10/2016 | Kullberg | F02N 3/02 |
| 2019/0285042 | A1* | 9/2019 | Densborn | F02N 5/02 |
| 2020/0378351 | A1* | 12/2020 | Frankenberg | F16F 1/12 |

FOREIGN PATENT DOCUMENTS

| | | | | |
|---|---|---|---|---|
| WO | WO-2013137783 | A1 * | 9/2013 | F02N 3/02 |
| WO | 2014137261 | A1 | 9/2014 | |

* cited by examiner

STARTER PULLEY ARRANGEMENT

TECHNICAL FIELD

The present disclosure relates to a starter pulley arrangement for an internal combustion engine, the arrangement comprising a cord drum configured to house a starting cord wound thereon, a driver configured to interact with a flywheel or other part connected to an engine crankshaft, and a torsion spring, connecting the cord drum to the driver, such that the cord drum can resiliently urge the engine crankshaft via the driver.

BACKGROUND

One example of such a starter pulley arrangement is shown in WO-2014/137261-A1. Using two separate parts between the starting cord and the crankshaft, and the addition of the torsion spring evens out the resistance experienced when pulling the starting cord, such that a user is able to start the engine more easily. One issue with starter pulley arrangements of this kind is their durability, as the parts wear against each other under influence of vibrations caused during use of the engine.

SUMMARY

One object of the present disclosure is therefore to provide a starter pulley arrangement with improved durability. This object is achieved by means of a starter pulley arrangement as defined in claim 1. More specifically, in a starter pulley arrangement of the initially mentioned kind, the torsion spring is tensioned in a resting position, where the driver does not influence the crankshaft. This has been found to reduce wear on the cord drum and the driver over long-term use and thus an improved durability of the arrangement as a whole.

The torsion spring may be pre-tensioned in the resting position to a torque exceeding 300 Nm. This has been found to efficiently prevent wear with some margin.

The driver may be provided with a driver projection facing the cord drum, and the cord drum may comprise a limiting projection and a biasing projection, between which the driver projection can travel as the cord drum and the driver are mutually rotated, abutting the biasing projection in the resting position. Both parts can be efficiently produced with injection moulding.

At least one slanted surface is provided on the biasing projection and/or the driver projection, such that the driver projection can climb on the biasing projection during assembling while pre-tensioning the torsion spring. This facilitates assembling of the parts as pre-tensioning can be achieved with the cord drum and the driver already in engagement.

At least one of the driver and the cord drum may be made of a polyamide, PA. Typically, both the cord drum and the driver may be made of a glass fiber reinforced aliphatic polyamide.

It may be advantageous to provide the driver and the cord drum in different polyamide materials. For example, the cord drum may be made in PA66 and the driver in PA 6.

The present disclosure further considers a handheld powertool comprising a starter pulley arrangement as indicated above. One specific considered example of a handheld powertool is a chainsaw.

DETAILED DESCRIPTION

Figure 1:
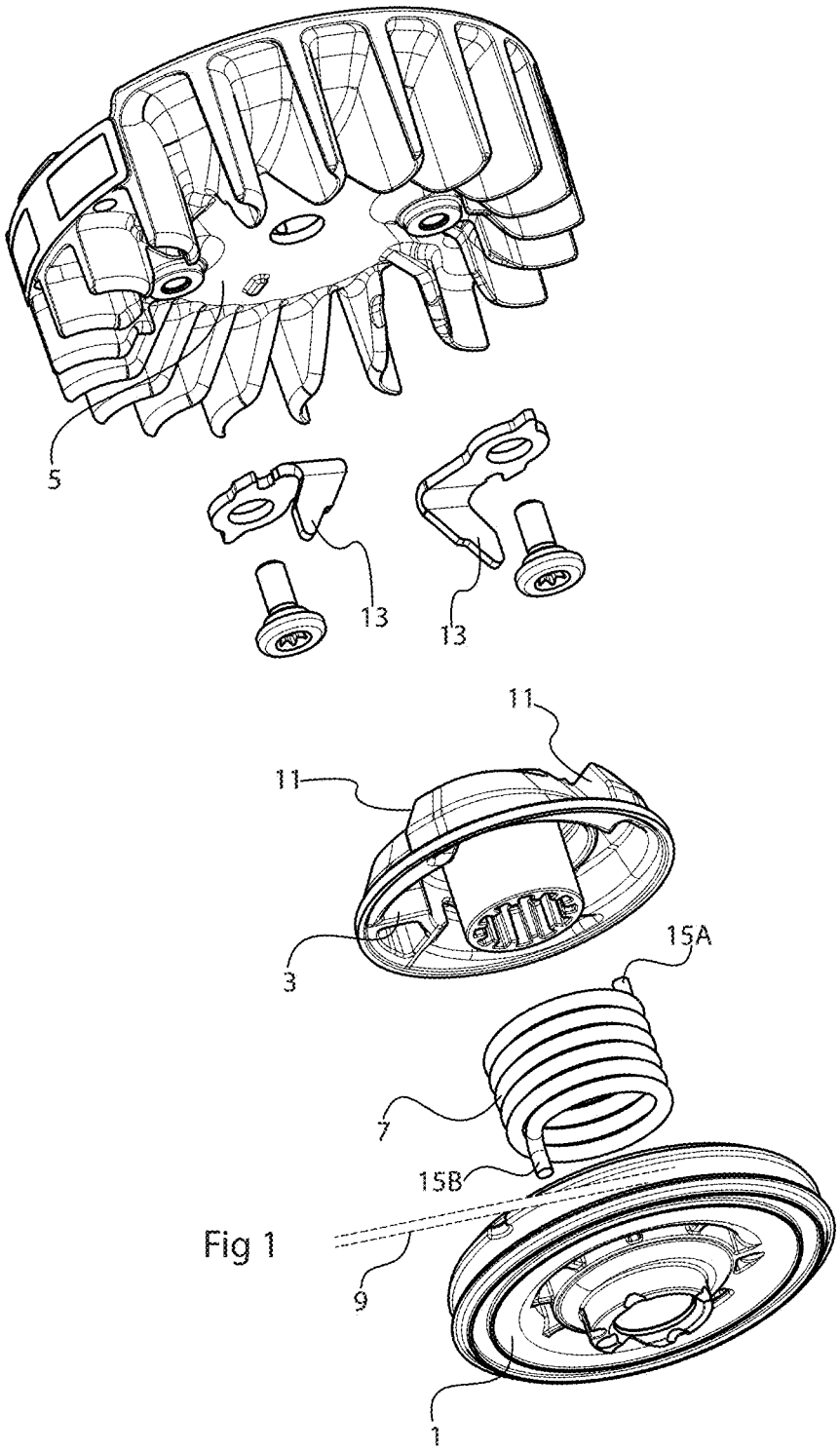
FIG. 1 shows starter pulley arrangement for an internal combustion engine.

FIG. 1 shows starter pulley arrangement for an internal combustion engine. In the illustrated case, the arrangement belongs to a two-stroke engine of a chainsaw. The elastic starter arrangement to be disclosed would be applicable to any engine that can be started by hand. However, the issue dealt with by this disclosure is particularly prominent in two-stroke engines where the resistance experienced when starting the engine fluctuates significantly, and in applications where vibrations could cause significant wear on included parts. This is the case in chainsaws as well as other power tools with one/single cylinder crankcase scavenged internal combustion engines.

As illustrated in FIG. 1, the starter pulley arrangement comprises a cord drum 1 configured to house a starting cord 9 wound thereon. When pulling the cord 9, the cord drum 1 rotates a driver 3, which in turn rotates the engine crankshaft to start the engine. In the illustrated case, the driver 3 comprises teeth 11 that engage with spring-loaded pawls 13 pivotably attached to a flywheel/fan 5 connected to the engine crankshaft, coaxially therewith. Once the engine starts, the spring-loaded pawls 13 swing out of engagement with the teeth 11, each against the force of a weak pawl spring (not shown), such that the engine runs free from the starter pulley arrangement. Then a cord retracting spring (not shown) rotates the cord drum 1 opposite to the pulling direction to retract the starting cord 9 back to its initial position. The driver could connect to the crankshaft in a different manner, for instance using a dedicated starting wheel as the skilled person realizes.

A torsion spring 7 connects the cord drum 1 to the driver 3. Thereby, the cord drum resiliently urges the engine crankshaft via the driver 3.

The torsion spring 7 is made of a helically wound spring wire. In principle, other types of springs are conceivable. The side of the driver 3 that faces the cord drum 1 comprises an opening (17, cf. FIGS. 2A, 2B) for an end 15A of the torsion spring 7 and the opposing end 15B of the torsion spring 7 fits in a corresponding opening (19, cf. FIGS. 3A, 3B) in the cord drum 1. Those ends 15A, 15B of the torsion spring thus deviate from the helical body of the torsion spring 7. As the cord drum 1 and the driver 3 are affixed rotatably on a common axis and are mutually fixed along this axis, the torsion spring is capable of transferring torque from the cord drum 1 to the driver 3.

The helical torsion spring 7 improves the starting procedure making it more user-friendly by dampening shocks felt when overcoming the starting resistance while pulling the starting cord 9. Also, to some extent, energy stored in the torsion spring 7 assists in overcoming engine torque resistance. Thus far, the starter pulley arrangement is similar to the one illustrated in the aforementioned document and its application is similar.

Figure 2A:
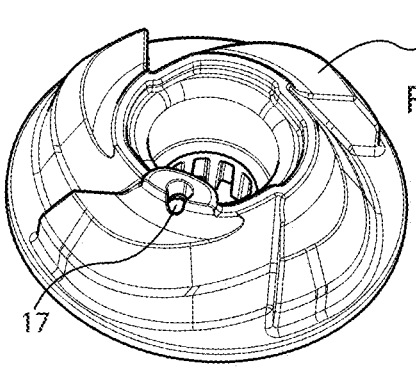
FIGS. 2A and 2B show two views of a driver for a starter pulley arrangement.
Figure 2B:
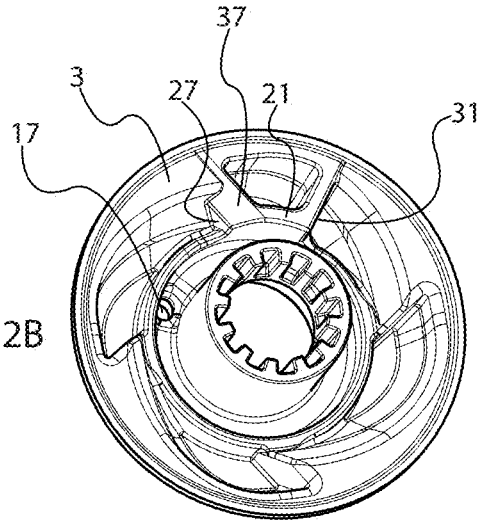
Figure 3A:
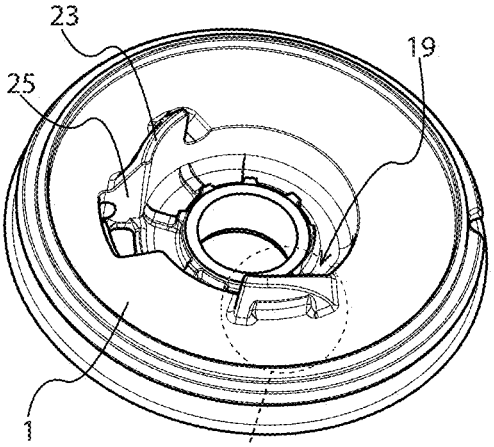
FIGS. 3A and 3B show two views of a cord drum for a starter pulley arrangement.
Figure 3B:
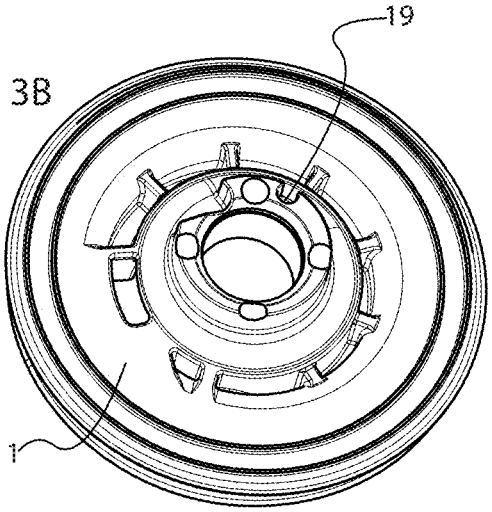

The present disclosure is concerned with an improvement in the interface between the cord drum 1 and the driver 3, mainly to improve the durability of those components when used daily over several years. This interface is now described with reference to FIGS. 2A and 2B showing the driver 3 and FIGS. 3A and 3B showing the cord drum 1.

Even though torque is to be transmitted from the cord drum 1 to the driver 3 via the torsion spring 7, this torque may be limited to ensure that the torsion spring 7 is not plastically deformed to any substantial extent by the pulling of the starting cord 9. To this end, the side of the driver 3 that faces the cord drum 1 is provided with a projection 21 as best seen in FIG. 2B. A corresponding limiting projection 23 is provided on the side of the cord drum 1 that faces the driver 3, as best seen in FIG. 3A. the limiting projection 23 acting as a dog comprises an abutment surface 25 that abuts a limiting abutment surface 27 of the driver's projection 21 at a maximum position when a maximum allowed torque is transferred by the torsional spring 7 when the starting cord 9, thereby avoiding a plastic, i.e. persistent, deformation of the torsional spring 7. Thus, the cord drum's 1 rotation in relation to the driver 3 in the pulling direction is limited to about 30 degrees.

In the present disclosure, the cord drum 1 further comprises a biasing projection 29. This projection limits the cord drum's 1 rotation in relation to the driver 3 opposite to the pulling direction. This means that in the resting state, when the start cord 9 is not being pulled, some pre-tensioning bias is provided to the torsional spring 7.

The projection 21 on the driver 3 thus also comprises a biasing abutment surface 31, and this surface will be pre-tensioned against an abutment surface 33 of the biasing projection 29, also defining a minimum torque applied to the torsional spring 7.

This pre-tensioning bias has been found to improve the durability of the cord drum 1 and the driver 3 during long-term use, especially in combination with the choice of materials to be discussed. Another advantage is that, as the start cord 9 is being pulled, some resisting torque is provided by the torsional spring 7 already initially. Therefore, the ineffective pull range that could otherwise be experienced can be reduced, where the user pulls the start cord 9 without affecting the engine shaft at all.

Generally, the torsion spring 7 is thus tensioned in the resting position where the driver 3 does not influence the crankshaft. A pre-tensioning torque exceeding 300 Nm is considered useful, more particularly exceeding 400 Nm. In the illustrated case a 455 Nm pre-tensioning is used which corresponds to a 20° pre-tensioning of a commonly used spring, as one example.

At manufacturing, the cord drum 1 and the driver are thus assembled with the torsional spring 7 pre-tensioned and the projection 21 of the driver 3 located between the limiting projection 23 and the biasing projection 29 of the cord drum 1. This manufacturing step can be made significantly easier by providing a slanted surface 35 on the biasing projection 29 or a slanted surface 37 on the projection of the driver 3 or, as illustrated, on both.

Figure 4:
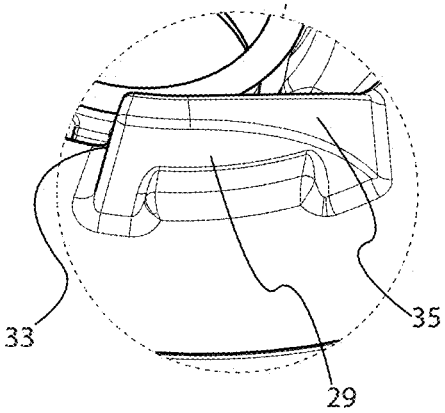
FIG. 4 shows an alternative version of a cord drum.
Figure 4:
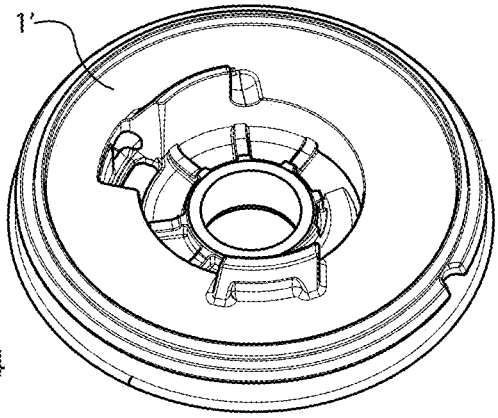

Thereby, it is possible to align the cord drum 1 and the driver 3 coaxially with the torsional spring 7 fastened therebetween in a relaxed state. The driver 3 is then turned, against the force of the torsional spring 7 such that the driver projection 21 climbs on the slanted surface 35 of the biasing projection 29 until the driver projection snaps in place between the biasing and limiting projections 29, 23. This is significantly easier than assembling the driver 3 and the cord drum 1 with the torsional spring 7 already biased. This is however also possible, and a version of the cord drum 1' without the slanted surfaces is shown in FIG. 4.

For instance, a chainsaw is quickly started and can then run a considering time until it runs out of fuel and need to be filled up end restarted. Therefore, during almost all the time the chainsaw is used, and the included parts are subjected to considerable vibrations, the starting pulley arrangement remains in the resting position where the starting cord is not used, and the torsional spring 7 biases the driver 3 against the cord drum 1 as described above. This reduces the wear which is a consequence of the vibrations. It has been found that this effect is further improved by the following choice of materials in the cord drum 1 and the driver 3. Rather than using Polyoxymethylene as has been the preferred choice, Polyamide is chosen for both parts. More specifically an Aliphatic Polyamide such as PA6 and PA66 is considered, and reinforced by glass fiber.

In one specific example the cord drum 1 is made from PA66 with a 30% glass fiber content by weight and optionally some additional graphite. For the driver 3 PA6 with a 30% glass fiber content is considered. It has been found that the use of slightly different materials in the two parts may reduce wear to some additional extent.

The invention is not restricted to the described embodiments and may be varied and altered in different ways within the scope of the appended claims.

The invention claimed is:

1. A starter pulley arrangement for an internal combustion engine, the arrangement comprising a cord drum configured to house a starting rope wound thereon, a driver configured to interact with a flywheel or other part connected to an engine crankshaft, and a torsion spring connecting the cord drum to the driver, such that the cord drum resiliently urges the engine crankshaft via the driver, wherein the torsion spring is tensioned in a resting position where the driver does not influence the engine crankshaft, wherein the driver is provided with a driver projection facing the cord drum, wherein the cord drum comprises a limiting projection and a biasing projection, and wherein at least one slanted surface is provided on the biasing projection and/or the driver projection, such that the driver projection climbs on the biasing projection during assembly while pre-tensioning the torsion spring.

2. The starter pulley arrangement according to claim 1, wherein the torsion spring is pre-tensioned in the resting position to a torque exceeding 300 Nm.

3. The starter pulley arrangement according to claim 1, wherein the driver projection is enabled to travel between the limiting projection and the biasing projection as the cord drum and the driver are mutually rotated, abutting the biasing projection in the resting position.

4. The starter pulley arrangement according to claim 1, wherein at least one of the driver and the cord drum are made of a polyamide.

5. The starter pulley arrangement according to claim 4, wherein both the cord drum and the driver are made of a glass fiber reinforced aliphatic polyamide.

6. The starter pulley arrangement according to claim 5, wherein the driver and the cord drum are made in different polyamide materials.

7. The starter pulley arrangement according to claim 5, wherein the cord drum is made in polyamide 66 (PA66) and the driver in polyamide 6 (PA6).

8. A handheld powertool comprising a starter pulley arrangement according to claim 1.

9. A handheld powertool according to claim 8, wherein the handheld powertool is a chainsaw.

* * * * *